US006828290B1

(12) United States Patent
Evers et al.

(10) Patent No.: US 6,828,290 B1
(45) Date of Patent: Dec. 7, 2004

(54) HARD SURFACE CLEANING COMPOSITIONS

(75) Inventors: Marc François Theophile Evers, Strombeek-Bever (BE); Roberta Margherita Romano, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/180,108

(22) PCT Filed: May 1, 1997

(86) PCT No.: PCT/US97/07228

§ 371 (c)(1),
(2), (4) Date: Nov. 3, 1998

(87) PCT Pub. No.: WO97/42276

PCT Pub. Date: Nov. 13, 1997

(30) Foreign Application Priority Data

May 3, 1996 (EP) ..... 96870058

(51) Int. Cl.[7] ..... C11D 17/00

(52) U.S. Cl. ..... 510/180; 510/191; 510/218; 510/214; 510/238; 510/421; 510/424; 510/505

(58) Field of Search ..... 510/191, 214, 510/238, 218, 424, 180

(56) References Cited

U.S. PATENT DOCUMENTS

| | | | | |
|---|---|---|---|---|
| 5,075,026 A | | 12/1991 | Loth et al. | 252/122 |
| 5,376,298 A | | 12/1994 | Michael | 252/153 |
| 5,382,376 A | | 1/1995 | Michael et al. | 252/153 |
| 5,393,468 A | | 2/1995 | Erilli et al. | 252/550 |
| 5,580,486 A | * | 12/1996 | Labeque et al. | 510/321 |
| 5,707,948 A | * | 1/1998 | Evers et al. | 510/217 |
| 5,759,989 A | | 6/1998 | Scialla et al. | 510/500 |

FOREIGN PATENT DOCUMENTS

| | | | |
|---|---|---|---|
| EP | 0 629 690 A1 | 12/1994 | C11D/1/825 |
| EP | 0 629 691 A1 | 12/1994 | C11D/3/37 |

* cited by examiner

*Primary Examiner*—Necholus Ogden
(74) *Attorney, Agent, or Firm*—Kevin L. Waugh

(57) ABSTRACT

The cleaning of hard surfaces is addressed, where no visible streaks or residues are left on the surfaces which have been cleaned. The invention encompasses several embodiments which combine a hydrophilic nonionic surfactant with a selected alcohol, in specific ratios, or a hydrophobic nonionic surfactant with a selected alcohol and a sulfated anionic surfactant, in specific ratios, or all these components together.

9 Claims, No Drawings

HARD SURFACE CLEANING COMPOSITIONS

TECHNICAL FIELD

The invention relates to the cleaning of hard surfaces, particularly but not exclusively floors.

BACKGROUND

Compositions for the cleaning of hard surfaces have been extensively discussed in the art. It is desirable that such compositions should have, in addition to the ability to clean effectively, the ability to provide a good shine to the surfaces they have cleaned. However, surface shine is often compromised by residues of the compositions which are left on the surfaces, and which appear as streaks as water evaporation is completed.

This problem becomes more acute when the compositions are used without rinsing after cleaning, and when the compositions are formulated as concentrated compositions, which comprise more actives and less water.

It is thus an object of the present invention to provide compositions for the cleaning of hard surfaces, which clean effectively in concentrated or diluted form, and which leave no or little streaks after the cleaning.

SUMMARY OF THE INVENTION

In a first embodiment, the invention encompasses the use, in a hard surface cleaning composition, of:

(a)-a hydrophilic nonionic surfactant; and (b)-a C8–C18 alcohol;

in a weight ratio of (a):(b) of from 1:1 to 10:1, for improved shine of hard surfaces which have been cleaned therewith.

In a second embodiment, the invention encompasses the use, in a hard surface cleaning composition, of:

(c)-a hydrophobic nonionic surfactant; and (d)-a sulfated anionic surfactant; and (b)-a C8–C18 alcohol;

in weight ratios of (c):(b) of from 5:1 to 25:1, and of (d):(c) of from 1:1 to 1:10, for improved shine of hard surfaces which have been cleaned therewith.

In a third embodiment, the invention combines the first two embodiments and thus encompasses the use, in a hard surface cleaning composition, of (a)-a hydrophilic nonionic surfactant; and (b)-a C8–C18 alcohol; and (c)-a hydrophobic nonionic surfactant; and (d)-a sulfated anionic surfactant;

in weight ratios of (a):(b) of from 1:1 to 10:1, of (c):(b) of from 5:1 to 25:1, and of (d):(c) of from 1:1 to 1:10, for improved shine of hard surfaces which have been cleaned therewith.

In a fourth embodiment, the invention encompasses a hard surface cleaning composition comprising (c)-a hydrophobic nonionic surfactant; and (d)-a sulfated anionic surfactant; and (b)-a C8–C18 alcohol;

in weight ratios of (c):(b) of from 5:1 to 25:1, and of (d):(c) of from 1:1 to 1:10.

Preferred in that fourth embodiment is a composition which further comprises a hydrophilic nonionic surfactant (a), and wherein additionally the weight ratios of (a):(b) of from 1:1 to 10:1.

The invention further encompasses processes of cleaning hard surfaces with the compositions, either dilute or neat.

DETAILED DESCRIPTION OF THE INVENTION

The Hard Surfaces

In some embodiments of the invention, various components are combined and used in a hard surface cleaning composition with a view to provide shine to the hard surfaces which are cleaned with the compositions. As used herein, "hard surfaces", typically refers to floors, walls, windows, kitchen and bathroom furniture, appliances and dishes.

Shine

Obtaining a good shine end result is essentially the sum of two factors, namely: a good spreading of the cleaning product on the surface, and no crystallisation while drying. If both are achieved, a streak-free end result is obtained. The streaking phenomenon can thus be described as the apparition of visible residues from the cleaning composition, as the water from the composition or the rinse water evaporates. Molecular crystallinity and aggregation during evaporation cause streaking, thus give a bad shine end result. Thus, as used herein, the ability of a composition to provide "shine" to surfaces refers to the composition's ability to leave little or no eye-visible residues on the surfaces, after evaporation of the water. In most cases, the ability of various compositions to provide shine can be evaluated by the human eye, but it is also possible to evaluate the difference by means of a gloss-meter, such as a Sheen® 155 gloss meter. A suitable method to evaluate a composition's ability to leave no or little residues is to first measure the gloss of a given surface, then apply the cleaning composition on the surface, then leave the composition to dry, and finally measure again the gloss of the surface on which the composition has been applied. The smaller the difference, the better the shine.

The Components

As a first component, component (a), the compositions herein comprise a hydrophilic nonionic surfactant, or mixtures thereof Suitable hydrophilic nonionic surfactants for use herein include alkoxylated alcohols, preferably ethoxylated alcohols. Such surfactants can be represented by the formula CxEOyH, where C symbolises the hydrocarbon chain of the alcohol starting material, x represents the length of its hydrocarbon chain. EO represents ethoxy groups and y represents the average degree of ethoxylation, i.e. the average number of moles of ethoxy groups per mole of alcohol. Suitable hydrophilic nonionic surfactants for use herein include those where x is of from 9 to 18, preferably 9 to 14, and average y is of from 8 to 30, preferably 10 to 20 Also suitable hydrophilic nonionic surfactants are ethoxylated and propoxylated alcohols which can be represented by the formula CxPOyEOy'H, where x is as above, and (y+y') is as y above. The compositions herein can comprise mixtures of such hydrophilic nonionics, and the compositions comprise from 0.5% to 8.0%, preferably from 1% to 4% by weight of the total composition of such hydrophilic nonionic surfactants, or mixtures thereof.

As a second component, component (b), the compositions herein comprise an alcohol having a hydrocarbon chain comprising 8 to 18 carbon atoms, preferably 12 to 16. The hydrocarbon chain can be branched or linear, and can be mono, di or polyalcohols. The compositions herein should comprise from 0.1% to 3% by weight of the total composition of such alcohol, or mixtures thereof, preferably from 0.1% to 1%.

As a third component, the compositions herein comprise a hydrophobic nonionic surfactant (c), or mixtures thereof. Suitable hydrophobic nonionic surfactants for use herein include alkoxylated alcohols, preferably ethoxylated alcohols. Such surfactants can be represented by the formula CxEOyH, where C symbolises the hydrocarbon chain of the alcohol starting material, x represents the length of its hydrocarbon chain. EO represents ethoxy groups and y represents the average degree of ethoxylation, i.e. the average number of moles of ethoxy groups per mole of alcohol. Suitable hydrophobic nonionic surfactants for use herein include those where x is of from 9 to 18, preferably 9 to 16, and y is of from 2 to 7, preferably 4 to 7. Suitable hydrophobic nonionic surfactants also include ethoxylated and propoxylated alcohols which can be represented by the formula CxPOyEOy'H, where x is as above x and where (y+y') is as y above. The compositions herein can comprise mixtures of such hydrophobic nonionics, and the compositions comprise from 1% to 20%, preferably from 3% to 15% by weight of the total composition of such hydrophobic nonionic surfactants, or mixtures thereof.

As a fourth component, (d), the compositions herein should comprise an anionic surfactant which is sulfated anionic surfactant, as opposed to a sulfonated anionic surfactant. Suitable sulfated anionic surfactants for use herein include alkyl sulfates and alkoxylated alkyl sulfates which can be made by sulfating an alcohol, or an alcohol alkoxylate, respectively. Typical alkoxylating groups for such surfactants are ethoxy and propoxy groups, and suitable alkyl ethoxy sulfates for use herein can be represented by the formula CxEOyS where C symbolises the hydrocarbon chain of the alcohol starting material, x represents the length of its hydrocarbon chain. EO represents ethoxy groups and y represents the average degree of ethoxylation, i.e. the average number of moles of ethoxy groups per mole of alcohol. And S stands for a sulfate group. Suitable alkyl ethoxy sulfates anionic surfactants for use herein include those where x is from 10 to 14 and y is from 1 to 5. Identically, suitable alkyl propoxy sulfates can be represented as CxPOyS, with identical ranges for x and y.

A particular sulfated anionic surfactant for use herein is a mixture of an ethoxylated alkyl sulfate and a propoxylated alkyl sulfate according to the formulas above. The compositions herein comprise from 0.5% to 10%, preferably from 0.5% to 4% of said sulfated anionic surfactant, or mixtures thereof.

An optional but highly preferred component herein is a particular builder system which further improves the cleaning performance without negatively affecting the shine. This fifth component, comprises a carbonate or polyphosphate salt, and a polycarboxylate salt, and preferably the weight ratio of polycarboxylate to carbonate or polyphosphate is at least 1:0.05. As used herein, "salt" refers to both the acidic form of all the builders suitable for use herein, or any of their salts.

Suitable carbonate builders for use herein are according to the formula $X_2CO_3$ or $XHCO_3$ where X is a suitable counterion, typically $K^+$, $Na^+$ $NH_4^+$. Suitable polyphosphates for use herein include compounds of formula $X_aH_bPO4$, where a and b are integers such that a+b=3, and a or b can be 0, or $X_aH_bP_3O_{10}$ where a and b are such that a+b=5, and a or b can be 0, and where X is a suitable counterion, particularly $K^+$, $Na^+$ or $NH4^+$.

Suitable polycarboxylates for use herein include organic polycarboxylates where the highest LogKa, measured at 25° C./0.1M ionic strength is between 3 and 8, wherein the sum of the LogKCa+LogKMg, measured at 25° C./0.1M ionic strength is higher than 4, and wherein LogKCa=LogKMg±2 units, preferably 1.5 units, measured at 25° C./0.1M ionic strength.

Such suitable and preferred polycarboxylates include citrate and compounds of the formula $$CH(A)(COOX)—CH(COOX)—O—CH(COOX)—CH(COOX)(B)$$

wherein A is H or OH; B is H or —O—CH(COOX)—$CH_2$(COOX); and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is —O—CH(COOX)—$CH_2$(COOX), then the compound is tartrate disuccinic acid (TDS) and its water-soluble salts. Mixtures of these builders are especially preferred for use herein. Particularly TMS to TDS, these builders are disclosed in U.S. Pat. No. 4,663,071, issued to Bush et al., on May 5, 1987.

Still other ether polycarboxylates suitable for use herein include copolymers of maleic anhydride with ethylene or vinyl methyl ether, 1, 3, 5-trihydroxy benzene-2, 4, 6-trisulfonic acid, and carboxymethyloxysuccinic acid.

Other useful polycarboxylate builders include the ether hydroxypolycarboxylates represented by the structure:

$$H0—[C(R)(COOM)—C(R)(COOM)—O]_n—H$$

wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$alkyl or $C_{1-4}$ substituted alkyl (preferably R is hydrogen).

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Preferred amongst those cyclic compounds are dipicolinic acid and chelidanic acid.

Also suitable polycarboxylates for use herein are mellitic acid, succinic acid, polymaleic acid, benzene 1,3,5-tricarboxylic acid, benzene pentacarboxylic acid, and carboxymethyloxysuccinic acid, and soluble salts thereof.

Still suitable carboxylate builders herein include the carboxylated carbohydrates disclosed in U.S. Pat. No. 3,723,322, Diehl, issued Mar. 28, 1973, incorporated herein by reference.

Other suitable carboxylates for use herein, which do not meet the above criteria are alkali metal, ammonium and substituted ammonium salts of polyacetic acids. Examples of polyacetic acid builder salts are sodium, potassium, lithium, ammonium and substituted ammonium salts of ethylenediamine, tetraacetic acid and nitrilotriacetic acid.

Other suitable polycarboxylates are those also known as alkyliminoacetic builders such as methyl imino diacetic acid, alanine diacetic acid, methyl glycine diacetic acid, hydroxy propylene imino diacetic acid and other alkyl imino acetic acid builders. Most preferred of all polycarboxylate builders for use herein is citrate.

The compositions herein comprise from 0.5% to 5% by weight of the total composition of the builder system, preferably from 0.5% to 3%.

Another feature of the compositions herein is that components (a) to (d) should be present in certain specified ratios. Accordingly, components (a) and (b) should be present in a weight ratio of (a) to (b) of from 1:1 to 10:1, preferably 2:1 to 7:1. Components (c) and (b) should be present in a weight ratio of (c) to (b) of from 5:1 to 25:1, preferably 10:1 to 20:1. And components (d) and (c) should be present in a weight ratio of (d) to (c) of from 1:1 to 1:10, preferably 1:2 to 1:6. Where a component is composed of a mixture of ingredients, as opposed to a single ingredient, the weight ratios herein are calculated on the basis of the weight amount of the component, i.e. the added amounts of the individual ingredients forming the component.

It is speculated that the compositions herein are combining three technology blocks which function on their own, but which find their preferred application when they are used together.

The first technology block is the combination of the selected hydrophilic nonionic surfactant with the selected alcohol, in the selected ratios. Indeed, these nonionic surfactants are particularly effective on particulate soils and on greasy soils, but they will cause streaking if they are used on their own.

The second technology block is the combination of the selected hydrophobic nonionic surfactant with the selected alcohol in the selected ratios, together with the selected sulfate anionic surfactants. Similarly to the first building block, these nonionic surfactants and anionic surfactants are particularly effective on particulate soils and on greasy soils, but they will cause streaking if they are used on their own. Addition of alcohol, in the selected ratios, results in a clear shine benefit.

The third technology block is the mixed builder system. Polycarboxylates with surfactants would cause streaking, and carbonate or polyphosphates with surfactants would cause a crystalline film to be deposited on the surface. But the combination of these builders, together with surfactants, leaves no visible streaks and no film. This performance improvement is particularly visible in presence of anionic surfactants, as these surfactants tend to form streaks already when pure.

The compositions herein can further comprise a variety of further, optional, ingredients. Such optionals include bleaches, enzymes, dyes, perfumes and other aesthetics.

The compositions herein are preferably formulated as aqueous liquids. They can comprise from 1% to 30% by weight of the total composition of actives, i.e. from 99% to 70% water. As used herein, "neat" refers to a composition comprising that amount of actives.

In a first mode, the composition herein is applied neat onto a surface so as to clean the surface, and is optionally but preferably subsequently removed by rinsing with water. In a second mode, the compositions is first diluted in water, typically from 40 to 320 times, and it is then applied to the surface to be cleaned. Thereafter, in this second mode, the composition can but does not necessarily have to be rinsed off of the surface. The first mode is generally more convenient for heavily soiled surfaces while the second mode is generally more convenient for large and lightly soiled surfaces such as floors.

The invention is further illustrated by the following examples

EXAMPLES

| | 1 | 2 | 3 | 4 | 5 | 6 | 7 | 8 | 9 | 10 | 11 |
|---|---|---|---|---|---|---|---|---|---|---|---|
| C12–14 EO20 | — | — | 1 | 1.7 | — | — | — | 1.4 | — | 2.5 | 1.8 |
| C12–14PO3EO7 | — | — | — | — | — | 2 | — | — | — | — | — |
| C12–14 EO10 | — | — | — | — | 2 | — | — | — | — | — | — |
| C10–12 EO10 | — | 1.5 | — | — | — | — | 2.0 | — | 1.0 | — | — |
| C9–11EO5 | 2.8 | — | 2.4 | — | 2.4 | 2.4 | — | 2.0 | — | 6 | 4.3 |
| C11EO5 | — | — | — | 5 | — | — | 4.0 | — | — | — | — |
| C12–14 EO5 | 4.2 | 3.0 | 3.6 | — | 3.6 | 3.6 | — | 3.6 | 4.5 | 9 | 6.4 |
| C9–11 EO4 | — | 3.0 | — | — | — | — | — | — | 3.0 | — | — |
| C12-OH | — | 0.3 | — | — | — | — | — | — | — | — | — |
| 2-Hexyl decanol | — | — | — | 0.4 | — | — | — | 0.3 | — | — | — |
| 2-Butyl octanol | 0.3 | — | 0.3 | — | 0.3 | 0.3 | 0.3 | — | 0.2 | 0.5 | 0.5 |
| C12–14 S | — | — | 1.0 | — | 1.0 | 1.0 | 1.2 | 1.5 | — | — | 1.8 |
| C12–14 EO3S | 1.0 | 1.3 | — | 1.5 | — | — | — | — | 1.5 | 2.5 | — |
| Citrate | 0.7 | 1.0 | 0.7 | 1.0 | 0.7 | 0.7 | 0.5 | 1.0 | 0.5 | 0.7 | 0.7 |
| Na2CO3 | 0.6 | 0.7 | 0.6 | 0.3 | 0.6 | 0.6 | 0.3 | 0.4 | 0.4 | 1 | 1.0 |

What is claimed is:

1. A hard surface cleaning composition comprising:

(c)-a hydrophobic nonionic surfactant of the formula $C_xPO_yEO_{y'}H$ wherein C represents the hydrocarbon chain of an alcohol, wherein x represents the length of the chain and is from 9 to 18, PO represents propoxy groups, EO represents ethoxy groups and y and y' represent, respectively the number of said groups and the sum of y and y' is from 2 to 7; and (d)-a sulfated anionic surfactant which is an ethoxylated alkyl sulfate wherein the alkyl group contains 12–14 carbon atoms and the degree of ethoxylation is from 1 to 5; and (b)-a C8–C18 alcohol;

in weight ratios of (c):(b) of from about 5:1 to about 25:1, and of (d):(c) of from about 1:1 to about 1:10;

wherein said composition comprises from 90.1% to 99% water.

2. A hard surface cleaning composition according to claim 1, which additionally comprises a hydrophilic nonionic surfactant (a) of the formula $C_xPO_yEO_{y'}H$ wherein C represents the hydrocarbon chain of an alcohol wherein x represents the length of the chain and is from 9 to 18, PO represents propylene oxide groups, EO represents ethylene oxide groups and y and y' represent, respectively, the number of said groups and the sum of y and y' is from 8 to 30, and wherein the weight ratio of (a):(b) is from about 1:1 to about 10:1 and wherein in Component (d) the degree of ethoxylation is 3.

3. A composition according to claim 1, which additionally comprises from about 0.5% to about 5% by weight of the total composition, of a builder system comprising a carbonate and a polycarboxylate salt.

4. A composition according to claim 3, wherein the weight ratio of said carbonate to said polycarboxylate is at least about 1:0.05.

5. A composition according to claim 1, which composes from about 0.5% to about 8.0% by weight of said hydrophilic nonionic surfactant (a), or mixtures thereof, and wherein said hydrophilic nonionic surfactant is an ethoxylated alcohol of formula CxEOyH, or an ethoxylated and propoxylated alcohol of formula CxPOyEOy'H, wherein C represents the hydrocarbon chain of an alcohol, wherein x is an integer of from about 9 to about 15, and y and (y+y') are an integer of from about 8 to about 30.

6. A composition according to claim 1, which comprises from about 1% to about 20% by weight of said hydrophobic nonionic surfactant (c), or mixtures thereof, and wherein said hydrophobic nonionic surfactant is an ethoxylated alcohol of formula CxEOyH or an ethoxylated and propoxylated alcohol of formula CxPOyEOy'H, wherein C represents the hydrocarbon chain of an alcohol, wherein x is an integer of from about 9 to about 14 and y and (y+y') is an integer of from about 2 to about 7.

7. A composition according to claim 1, which comprises from about 0.1% to about 3% by weight of said alcohol (b), and said alcohol is a C12–C16 alcohol.

8. A process of cleaning a hard surface wherein a composition according to claim is applied neat onto the surface, and optionally subsequently rinsed off of the surface.

9. A process of cleaning a hard surface wherein a composition according to claim 1 is diluted in water, then applied onto the surface, and subsequently optionally rinsed off of the surface.

* * * * *